United States Patent [19]

Broscheit

[11] 3,986,517

[45] Oct. 19, 1976

[54] METHOD AND APPARATUS FOR MIXING STREAMS OF SEPARATELY TREATED TOBACCO

[75] Inventor: Wolfgang Broscheit, Trittau, Germany

[73] Assignee: Hauni-Werke Korber & Co., KG, Hamburg, Germany

[22] Filed: Jan. 17, 1975

[21] Appl. No.: 542,015

[30] Foreign Application Priority Data

Feb. 8, 1974 Germany ..... 2405947

[52] U.S. Cl. ..... 131/21 C; 131/22 R

[51] Int. Cl.² ..... A24B 7/14

[58] Field of Search ..... 131/21 R, 135, 138, 131/21 C, 21 A, 21 B, 21 D, 22 R; 34/56

[56] References Cited

UNITED STATES PATENTS

| | | | |
|---|---|---|---|
| 1,967,487 | 10/1934 | Elberty, Jr. | 131/135 UX |
| 3,794,049 | 2/1974 | Wochnowski | 131/135 |
| 3,831,610 | 8/1974 | Wochnowski | 131/21 R |

FOREIGN PATENTS OR APPLICATIONS

| | | | |
|---|---|---|---|
| 441,781 | 1/1935 | United Kingdom | 131/138 |

*Primary Examiner*—Robert W. Michell
*Assistant Examiner*—V. Millin
*Attorney, Agent, or Firm*—Peter K. Kontler; John Kurucz

[57] ABSTRACT

Tobacco shreds which are conveyed from a source in the form of a continuous stream are mixed with expanded tobacco ribs in such a way that the ratio of dry weights of successive unit lengths of the two streams which reach a mixing station remains constant. To this end, the moisture content of successive unit lengths of the two streams is measured by discrete detectors, and the overall weight of successive unit lengths of the stream of tobacco shreds is determined by a weighing device. A first analog computer is connected with the moisture detector for tobacco shreds and with the weighing device and transmits signals which are indicative of the dry weight of successive unit lengths of the stream of shreds. A ratio selector circuit determines the required dry weight of successive unit lengths of the rib stream in response to signals from the first computer and transmits such signals to a second analog computer which is further connected with the moisture detector for the rib stream. The signal at the output of the second computer is used to control the speed of a feeding conveyor which regulates the quantity of tobacco in successive unit lengths of the rib stream.

10 Claims, 1 Drawing Figure

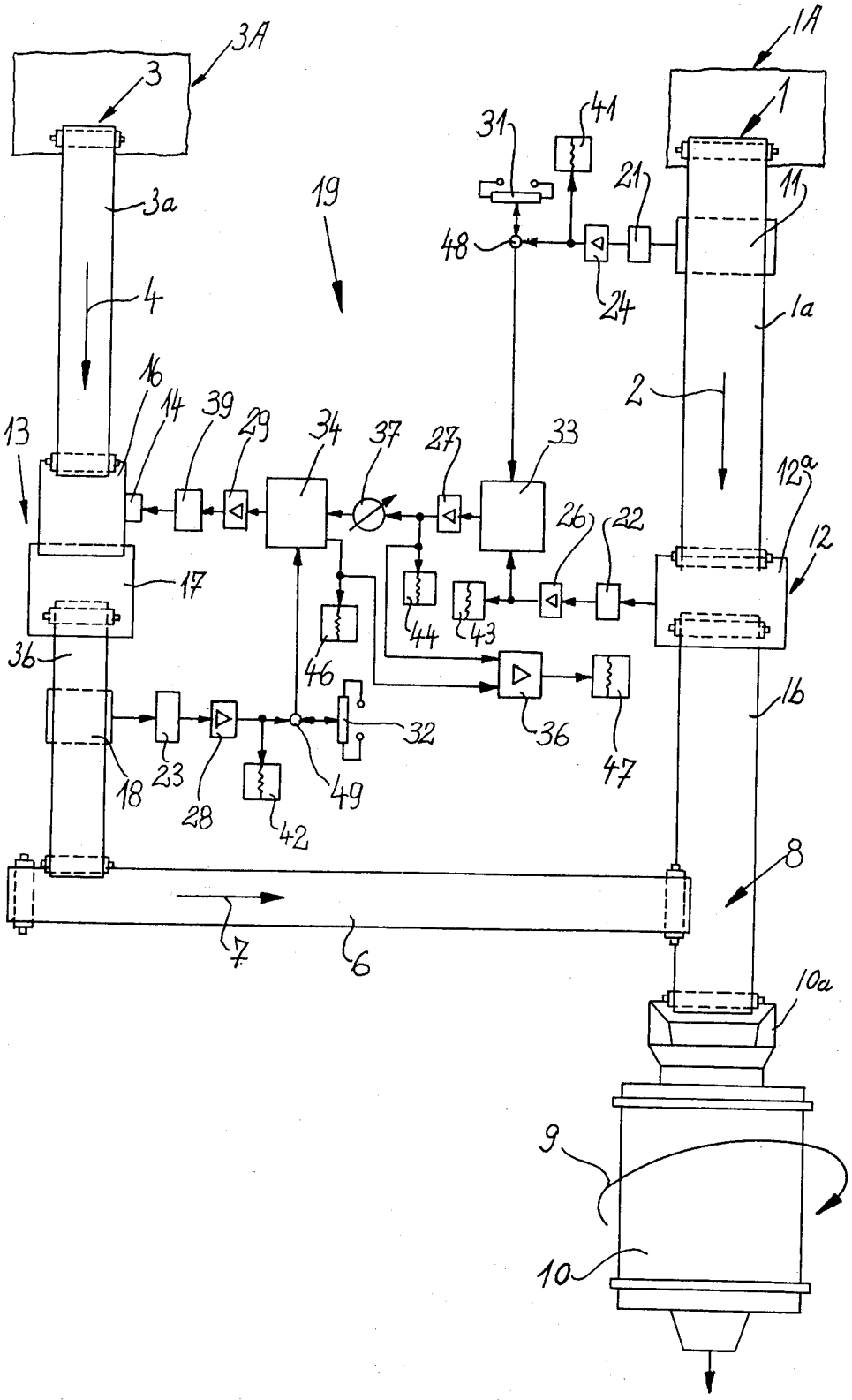
3A
3
3a
4
19
1A
1
11
1a
2
31
41
21
48
24
13
16
14
39
29
34
37
27
33
12a
12
26
22
17
44
43
46
36
32
36
47
1b
18
23
28
42
49
8
7
6
10a
9
10

METHOD AND APPARATUS FOR MIXING STREAMS OF SEPARATELY TREATED TOBACCO

BACKGROUND OF THE INVENTION

The present invention relates to a method and apparatus for mixing at least two streams of separately treated tobacco, and more particularly to a method and apparatus for blending first and second types of tobacco (e.g., two different types of tobacco shreds; two different types of tobacco leaves; tobacco shreds and fragments of tobacco ribs, stem and/or birds' eyes; expanded and unexpanded fragments of tobacco ribs; or others) in such a way that the ratio of dry weights of the two tobacco types remains constant irrespective of fluctuations of dry weight of tobacco in successive unit lengths of the one and/or the other stream. Still more particularly, the invention relates to a method and apparatus for automatically blending several tobacco types in such a way that the ratio of dry weights of all tobacco types in the resulting mixture remains constant.

It is well known that many smokers' products (including plain or filter-tipped cigarettes, cigarillos, cigars and cheroots as well as chewing tobacco or sniffing tobacco) contain different types of tobacco. Such different types can be mixed with each other prior or subsequent to comminution of tobacco leaves into shreds and ribs and prior or subsequent to segregation of ribs from tobacco leaf laminae. For example, green tobacco leaves are often destalked and/or their tips removed. The thus removed material is thereupon conditioned separately from the remaining material (laminae). The separately treated portions of green leaves are thereafter mixed with each other, either for the purpose of obtaining the original ratio or to obtain a different ratio of laminae to ribs and/or tips.

The ratio of separately treated tobacco leaf portions in a mixture is particularly important in the manufacture of many types of cigarettes wherein the filler contains shredded tobacco leaf laminae and a certain percentage of comminuted ribs, stem and birds' eyes. The just mentioned ratio is even more important when the separate treatment to which the ribs are subjected independently of shreds includes a puffing or expansion which normally involves impregnating the fragments of ribs with a gaseous or liquid fluid and thereupon rapidly heating the thus impregnated ribs to an elevated temperature at which the outer strata of ribs harden to confine the fluid therein whereby the volume of the thus treated ribs greatly exceeds the original volume.

SUMMARY OF THE INVENTION

An object of the invention is to provide a novel and improved method of accurately mixing several tobacco types in such a way that the ratio of dry weights (i.e., of the overall weight of unit lengths of streams of the respective tobacco types minus the weight of the moisture which is contained therein) of all tobacco types in the mixture remains constant or deviates negligibly from a desirable optimum ratio.

Another object of the invention is to provide a method of mixing at least two tobacco types in such a way that the ratio of dry weights of the two tobacco types in the mixture remains constant irrespective of fluctuations in the moisture content and/or weight of successive increments or unit lengths of tobacco streams which are being transported to a mixing station.

A further object of the invention is to provide a method which insures that the taste and/or aroma of a mixture of two or more tobacco types remains unchanged and that such characteristic or characteristics of the mixture can be selected in advance with a high degree of reproducibility.

An additional object of the invention is to provide a novel and improved apparatus which can be utilized for the practice of the above outlined method.

Still another object of the invention is to provide a novel and improved apparatus for mixing shredded tobacco leaf laminae with fragmentized tobacco ribs, especially with expanded ribs.

One feature of the invention resides in the provision of a method of adding a second type of moisture-containing tobacco (e.g., expanded tobacco ribs) to a first type of moisture-containing tobacco (e.g., shredded tobacco leaf laminae) at a mixing station. The method comprises the steps of conveying to the mixing station a first continuous stream consisting of the first tobacco type, conveying to the mixing station a second continuous stream consisting of the second tobacco type, measuring the moisture content of successive unit lengths or increments of the first stream, comparing the measured moisture content with a first predetermined moisture content, measuring the moisture content of successive unit lengths or increments of the second stream, comparing the measured moisture content of successive unit lengths of the second stream with a second predetermined moisture content, and varying the quantity of tobacco in successive unit lengths of the second stream when the measured moisture content of at least one of the streams deviates from the respective predetermined moisture content in order to insure that the ratio of dry weight (i.e., the overall weight minus the weight of moisture) of successive unit lengths of the first stream to the dry weight of successive unit lengths of the second stream at the mixing station remains constant.

The method may further comprise the steps of measuring the overall weight (i.e., the dry weight plus the weight of moisture) of successive unit lengths of the first stream and determining the dry weight of successive unit lengths of the first stream on the basis of measurements including the measurement of moisture content of successive unit lengths of the first stream and the measurement of overall weight of successive unit lengths of the first stream; the aforementioned step of varying the quantity of tobacco in successive unit lengths of the second stream then preferably comprises selecting the requisite dry weights of successive unit lengths of the second stream in order to maintain constant the ratio of dry weights of successive unit lengths of the first and second streams at the mixing station and determining the corresponding overall weight of successive unit lengths of the second stream on the basis of the selected requisite dry weight and also on the basis of measured moisture content of successive unit lengths of the second stream.

The method may further comprise the step of intimately intermixing the tobacco of successive unit lengths of the first and second streams downstream of the mixing station, e.g., in a rotary blending drum which may be provided with means for admitting casing or the like.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a partly diagrammatic plan view of an apparatus which embodies one form of the invention.

DESCRIPTION OF THE PREFERRED EMBODIMENTS

The drawing shows a mixing apparatus wherein a stream of tobacco shreds is advanced along a first path (indicated by arrow 2) by a first transporting device 1 including a pair of aligned belt conveyors 1*a*, 1*b*. The conveyor 1*a* receives a continuous stream of tobacco shreds from a first source 1A (e.g., a magazine from which the shreds are being withdrawn by an endless carded belt or the like). The means for transferring successive unit lengths or increments of the stream of tobacco shreds from the conveyor 1*a* to the conveyor 1*b* comprises a quantity monitoring means 12, e.g., a weighing device including an endless belt 12*a* and a transducer 22 serving to produce electric signals having an intensity or another characteristic which is indicative of the overall weight of successive increments of the stream. Such quantity monitoring means are well known and are used in many types of tobacco conditioning machines. A moisture detector 11 (e.g., a detector of the type known as HWK produced by Hauni-Werke, of Hamburg, Western Germany) is adjacent to the path of the tobacco stream on the conveyor 1*a* and includes a transducer 21 which transmits electric signals having an intensity or another characteristic indicative of the moisture content of successive unit lengths or increments of the stream on the conveyor 1*a*. The conveyor 1*b* transports the tobacco stream toward and through a mixing station 8 and thereupon into a chute 10*a* which feeds tobacco into a blending unit here shown as including a rotary drum 10 driven to rotate in the direction indicated by arrow 9 and serving to thoroughly intermix tobacco shreds with another type of tobacco which is being supplied to the mixing station 8. Thus, the portion of the conveyor 1*b* which travels from the station 8 to the chute 10*a* transports shredded tobacco as well as a second type of tobacco, for example, puffed fragments of tobacco ribs and stem which are partially mixed with shreds on the conveyor 1*b* and are more intimately mixed with shreds in the rotating drum 10. The latter preferably comprises means for admitting to the mixture of tobacco shreds and ribs casing and/or other flavoring agents, depending on the desired taste or aroma of the blend which issues from the drum 10 and is ready to be fed to the magazine of a cigarette rod making machine or to a further conditioning station, e.g., to apparatus wherein the moisture content of the blend is changed so that it matches or very closely approaches a desired moisture content.

A second transporting device 3 of the improved mixing apparatus draws puffed or expanded ribs and stem from a second source 3A and transports a continuous stream of ribs and stem (hereinafter called ribs for short) along a second path which is indicated by arrows 4 and 7. The transporting device 3 comprises three belt conveyors 3*a*, 3*b* and 6. The conveyor 3*a* receives a continuous stream of ribs from the source 3A, the conveyor 3*b* delivers successive unit lengths of increments of the rib stream to the conveyor 6, and the latter delivers the rib stream to the mixing station 8, i.e., onto the conveyor 1*b* of the transporting device 1. A moisture detector 18 is installed adjacent to the path of the rib stream on the conveyor 3*b;* this detector comprises a transducer 23 serving to transmit electric signals whose intensity or another characteristic is indicative of the moisture content of successive unit lengths or increments of the stream on the conveyor 3*b*. The conveyor 3*b* receives ribs from the conveyor 3*a* in an indirect manner, namely, through the medium of a metering or quantity-varying unit 13 having a feeding conveyor 16 which receives ribs from the discharge end of the belt conveyor 3*a* and is driven by a variable-speed prime mover 14. The feeding conveyor 16 supplies ribs to a weighing device 17 (the device 17 may be similar to or identical with the weighing device 12) which delivers ribs to the belt conveyor 3*b*. The weighing device 17 may (but need not) have a transducer (such as the transducer 22 of the weighing device 12); instead, the device 17 may be provided with a movable pointer and a scale which allows for visual observation of the overall weight of successive increments of the rib stream.

The stream which is being advanced by the transporting device 1 is assumed to consist primarily or exclusively of fragments of tobacco leaf laminae, i.e., of shreds which have been segregated from fragments of ribs, stem and birds' eyes and whose moisture content is constant or nearly constant. The stream which is being advanced by the transporting device 3 is assumed to consist of "puffed" ribs which have been expanded by a gaseous or liquid fluid in a manner well known from the art, i.e., their volume exceeds appreciably the volume prior to puffing and such volume has been stabilized (subsequent to treatment with a fluid) in any suitable way, for example, by short-lasting heating to an elevated temperature which causes a hardening of the outer strata so that the fluid remains entrapped in the interior of fragmentized ribs. The admixture of puffed or expanded ribs to shredded tobacco is desirable for a number of reasons, e.g., to insure satisfactory burning of tobacco while a cigarette is being smoked, to properly fill the wrappers of cigarettes without unduly increasing the weight of the fillers, and to enhance the "feel" of the cigarette in the hand of a smoker.

The mixing apparatus further comprises an evaluating and adjusting circuit 19 whoe primary purpose is to vary the speed of the prime mover 14 for the feeding conveyor 16 in dependency on changes in the moisture content of tobacco ribs and/or tobacco shreds. The circuit 19 comprises a first signal comparing junction 48 which has a first input connected with the output of the transducer 21 by way of an amplifier 24, a second input connected with an adjustable potentiometer 31 or an analogous rated value selector for the moisture content of tobacco shreds, and an output which is connected with one input of a multiplying circuit 33 (e.g., an analog computer of the type known as AD 530 produced by Analog-Devices GmbH, of Munich, Western Germany). A recording unit 41 (e.g., a recorder of the type similar to that used to record, with a stylus on a sheet or disk of paper, the speed, mileage and/or total operating time of an automotive vehicle) receives signals from the amplifier 24 and serves to furnish a permanent record of fluctuations of the moisture content in successive increments or unit lengths of the stream on the belt conveyor 1*a*.

The circuit 19 further comprises a second amplifier 26 which connects the transducer 22 with a second input of the multiplying circuit 33 with a second recording unit 43. The latter records fluctuations in the overall weight of successive increments of the stream on the transporting device 1. The output of the multiplying circuit 33 is connected (by an amplifier 27) with the input of a ratio selector circuit 37 (e.g., a potentiometer), with a recording unit 44 and with one input of an amplifier 36 (e.g., an amplifier known as μA 741 produced by Texas Instruments, Inc., of Dallas, Tex.) for a further recording unit 47. The output of the ratio selector 37 is connected with one input of a dividing circuit 34 (e.g., an analog computer identical with or similar to the computer 33). A second input of the dividing circuit 34 is connected with the output of the transducer 23 by way of an amplifier 28 and a signal comparing junction 49. The junction 49 has an output which is connected with the second input of the circuit 34, a first input which is connected with the amplifier 28, and a second input which is connected with an adjustable potentiometer 32 or another suitable rated value selector for the moisture content of ribs. The output of the amplifier 28 is further connected with a recording unit 42 which provides a permanent record of fluctuations of the moisture content of the rib stream. A first output of the dividing circuit 34 is connected with a recording unit 46 and with the other input of the amplifier 36 for the recording unit 47. A second output of the dividing circuit 34 is connected with the variable-speed prime mover 14 for the feeding conveyor 16 by way of an amplifier 29 and a control means 39 (e.g., a servomotor which can adjust the speed of the prime mover 14). The prime mover 14 may be a variable-speed motor or a prime mover which includes a constant-speed motor and a variable-speed transmission whose ratio is adjustable by the control means 39 and whose output element drives a pulley for the feeding conveyor 16.

The units 41, 42, 43, 44, 46, 47 respectively record the moisture content (in percent) of the stream of tobacco shreds, the moisture content (in percent) of the rib stream, the overall weight of successive increments or unit lengths of the stream of tobacco shreds, the dry weight of the stream of tobacco shreds, the dry weight of the rib stream, and the combined dry weight of the two streams.

THE OPERATION

The belt conveyor 1*b* of the transporting device 1 advances a continuous stream of tobacco shreds to the mixing station 8. This station further receives a continuous stream of ribs which are advanced by the belt conveyor 6 of the transporting device 3. The detector 11 determines the moisture content (in percent) of successive increments or unit lengths of the stream on the conveyor belt 1*a*, and the signal which is transmitted by the transducer 21 to the junction 48 via amplifier 24 is indicative of such moisture content. The junction 48 compares the intensity or another characteristic of such signal with the corresponding characteristic of the signal from the potentiometer 31 and transmits a signal when the characteristics of the two signals are different, i.e., when the measured moisture content of tobacco shreds is less than or exceeds the desired or predetermined moisture content as indicated by the signal from the potentiometer 31. The signal from the junction 48 is transmitted to the corresponding input of the multiplying circuit 33 which further receives a signal from the transducer 22 via amplifier 26. The signal from the transducer 22 is indicative of the overall weight of successive increments or unit lengths of the stream of tobacco shreds on the endless belt 12*a* of the weighing device 12. Thus, the signal which is transmitted by the transducer 22 indicates the dry weight of tobacco shreds plus the weight of moisture in the respective increments or unit lengths of the stream on the transporting device 1. The circuit 33 transmits to the amplifier 27 a signal which is indicative of the dry weight ($T_{Gb}$) of successive increments of the stream of tobacco shreds on the transporting device 1. The computation which is carried out by the circuit 33 can be expressed by the following equation:

$$T_{Gb} = F_{Gb} - \frac{F_{Gb} \cdot \Delta F_{Pb}}{100}$$

wherein $F_{Gb}$ is the overall weight of tobacco shreds (e.g., in kilograms per hour) and $F_{Pb}$ is the moisture content of tobacco shreds (in percent of $H_2O$).

The signal (indicating the dry weight $T_{Gb}$) at the output of the multiplying circuit 33 is amplified by the amplifier 27, and the amplified signal is transmitted to the ratio selector circuit 37 which automatically calculates the necessary dry weight of the rib stream (i.e., that quantity of ribs — without considering their moisture content — which is to be admixed to successive increments of the stream of tobacco shreds on the conveyor 1*b*). The signal from the ratio selector circuit 37 to the corresponding input of the dividing circuit 34 is indicative of the necessary or selected dry weight of the rib stream. The other input of the circuit 34 simultaneously receives a signal from the junction 49, and such signal is indicative of eventual deviations of the measured moisture content of the rib stream from a desired or predetermined moisture content as selected by the setting of the potentiometer 32. Thus, the lower input of the circuit 34 receives a signal only when the measured moisture content of the rib stream deviates from the desired moisture content. The signal which is transmitted from the circuit 34 to the amplifier 29 is indicative of the desired speed of the feeding conveyor 16 in order to insure that the dry weight of the rib stream which reaches the mixing station 8 will correspond to that determined by the ratio selector circuit 37. The computation which is performed by the circuit 34 can be expressed by the following equation:

$$F_{Gr} = T_{Gb} \cdot f \cdot \frac{100}{100 - \Delta F_{Pr}}$$

wherein $F_{Gr}$ is the overall weight of the rib stream (for example, in kilograms per hour), $F_{Pr}$ is the moisture content of the rib stream (in percent of $H_2O$), $f$ is the calculated or selected percentage of rib stream in the mixture advancing on the conveyor 1*b* beyond the station 8 (this percentage is selected by the circuit 37), and $T_{Gb}$ is the dry weight of the tobacco shreds (for example, in kilograms per hour).

The signal from the circuit 34 is amplified by the amplifier 29 and is transmitted to the control means 39 which adjusts the prime mover 14 accordingly so that the dry weight of tobacco ribs which reach the mixing station 8 corresponds to the value selected by the circuit 37 in dependency on the dry weight $T_{Gb}$ of the shreds. The prime mover 14 accelerates the feeding conveyor 16 when the moisture content of tobacco shreds is less than that selected by the potentiometer 31 and/or when the moisture content of ribs is higher than that selected by the potentiometer 32. Analogously, the signal from the control means 39 causes the prime mover 14 to decelerate the conveyor 16 when the moisture content of tobacco shreds is excessive and/or when the moisture content of the ribs is too low.

The ribs are mixed with tobacco shreds first on the belt conveyor 1*b* and thereupon in the rotating drum 10 of the blending unit. The signals which the amplifier 36 receives from the circuits 33 and 34 are computed and transmitted to the unit 47 which records the dry weight of successive increments of the mixture of the two streams entering the drum 10, i.e., the combined dry weight of the stream of tobacco shreds and the stream of tobacco ribs on the conveyor 1*b* downstream of the station 8.

An important advantage of the improved method and apparatus is that the ratio of the dry weight of shreds to the dry weight of ribs in the drum 10 remains unchanged irrespective of upward or downward fluctuations of the moisture content of the stream on the transporting device 1 and/or 3. This insures that the quality of cigarettes or other smokers' products whose fillers contain the mixture of ribs and shreds issuing from the drum 10 remains unchanged. Moreover, the provision of a substantial number of recording units renders it possible to readily determine the cause of eventual fluctuations of the rate of transport of the ribs and/or shreds as well as the cause of eventual fluctuations of the moisture content of the stream on the transporting device 1 and/or 3 so that such defects can be eliminated with a minimum of delay. However, even such fluctuations in the rate of feed and/or deviations of the moisture content from a desirable or predetermined moisture content do not affect the ratio of shreds (dry weight) to the ribs (dry weight) in the drum 10, i.e., such ratio remains unchanged.

In the appended claims, the term "moisture-containing" is intended to denote tobacco whose moisture content is zero, slightly above zero or well above zero. Also, the term "predetermined moisture content" is intended to denote zero moisture content or a moisture content which is slightly or substantially higher than zero.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A method of adding a second type of moisture-containing tobacco to a first type of moisture-containing tobacco at a mixing station, comprising the steps of a. conveying to the mixing station a first continuous stream consisting of said first tobacco type;

b. conveying to said mixing station a second continuous stream consisting of said second tobacco type;

c. measuring the moisture content of successive unit lengths of said first stream;

d. comparing the measured moisture content with a first predetermined moisture content;

e. measuring the moisture content of successive unit lengths of said second stream;

f. comparing the moisture content measured in the step (e) with a second predetermined moisture content; and g. varying the quantity of tobacco in successive unit lengths of said second stream when the measured moisture content of at least one of said streams deviates from the respective predetermined moisture content in order to insure that the ratio of dry weight, that is the overall weight minus the weight of moisture, of successive unit lengths of the first stream to the dry weight of successive unit lengths of the second stream at the mixing station remains constant.

2. A method as defined in claim 1, further comprising the steps of h. measuring the overall weight of successive unit lengths of said first stream; and i. determining the dry weight of successive unit lengths of said first stream on the basis of measurements including the steps (c) and (h);

said step (g) including selecting the requisite dry weight of successive unit lengths of said second stream in order to maintain constant the ratio of dry weights of successive unit lengths of said first and second streams at said mixing station and determining the corresponding overall weight of successive unit lengths of said second stream on the basis of the selected requisite dry weight and the measured moisture content of successive unit lengths of said second stream.

3. A method as defined in claim 1, wherein said first type of tobacco includes tobacco shreds.

4. A method as defined in claim 1, wherein said second type of tobacco includes tobacco ribs.

5. A method as defined in claim 1, further comprising the steps of intimately intermixing the tobacco of successive unit lengths of said first and second streams downstream of said station.

6. Apparatus for adding a second type of moisture-containing tobacco to a first type of moisture-containing tobacco at a mixing station, comprising first and second sources respectively containing tobacco of said first and second types; first and second transporting means for respectively advancing continuous first and second streams of tobacco from said first and second sources to said mixing station; adjustable feeding means for changing the rate at which said second transporting means advances tobacco to said station; first and second detector means for respectively measuring the moisture content of successive unit lengths of said first and second streams; means for producing signals when the moisture content measured by said first and second detector means respectively deviates from a first and second predetermined moisture content; and means for adjusting said feeding means in response to said signals in order to insure that the ratio of dry weight, that is the overall weight minus the weight of moisture, of successive unit lengths of the first stream to the dry weight of successive unit lengths of the second stream at the mixing station remains constant.

7. Apparatus as defined in claim 6, further comprising means for weighing successive unit lengths of said first stream including transducer means for producing signals indicative of the overall weight of successive unit lengths of said first stream, said adjusting means comprising a first circuit having first and second inputs respectively connected with said first detector means and said transducer means and an output which transmits signals indicating the dry weight of successive unit lengths of said first stream, a second circuit having an input connected to said output and an output which transmits signals indicating that selected dry weight of successive unit lengths of said second stream which is necessary to maintain constant the ratio of dry weights of successive unit lengths of said first and second streams at said station, a third circuit having first and second inputs respectively connected to said second detector means and to the output of said second circuit and an output which transmits signals indicating that overall weight of successive unit lengths of said second stream which corresponds to said selected dry weight, and control means for adjusting said feeding means in response to signals transmitted by the output of said third circuit.

8. Apparatus as defined in claim 7, wherein at least one of said first and third circuits is an analog computer.

9. Apparatus as defined in claim 6, wherein at least one of said transporting means comprises a plurality of discrete conveyors.

10. Apparatus as defined in claim 6, further comprising means for intimately intermixing successive unit lengths of said streams downstream of said station.

* * * * *

UNITED STATES PATENT OFFICE

CERTIFICATE OF CORRECTION

Patent No. 3,986,517 Dated October 19, 1976

Inventor(s) Wolfgang BROSCHEIT

It is certified that error appears in the above-identified patent and that said Letters Patent are hereby corrected as shown below:

Page 1, under [73] assignee's name should read --Hauni-Werke Körber & Co. KG--

Page 1, the orientation of illustration shown on page 1 of the patent should be inverted.

Signed and Sealed this

First Day of March 1977

[SEAL]

*Attest:*

RUTH C. MASON
*Attesting Officer*

C. MARSHALL DANN
*Commissioner of Patents and Trademarks*